US006672016B2

(12) United States Patent
Janesky

(10) Patent No.: US 6,672,016 B2
(45) Date of Patent: Jan. 6, 2004

(54) WALL AND SUB-FLOOR WATER DRAIN BARRIER PANEL FOR BASEMENT WATER-CONTROL SYSTEMS

(76) Inventor: Lawrence M. Janesky, 11 Fawn Meadow La., Huntington, CT (US) 06484

( * ) Notice: Subject to any disclaimer, the term of this patent is extended or adjusted under 35 U.S.C. 154(b) by 127 days.

(21) Appl. No.: 09/822,980

(22) Filed: Mar. 30, 2001

(65) Prior Publication Data

US 2002/0139068 A1 Oct. 3, 2002

(51) Int. Cl.[7] ..... E02D 19/06

(52) U.S. Cl. ..... 52/169.5; 52/169.14; 405/38; 405/50

(58) Field of Search ..... 52/169.1, 169.5, 52/169.14, 169.11; 405/36, 38, 43.45, 50, 229

(56) References Cited

U.S. PATENT DOCUMENTS

| | | | | | |
|---|---|---|---|---|---|
| 3,888,087 | A | * | 6/1975 | Bergsland | 61/11 |
| 4,245,443 | A | | 1/1981 | Beechen | |
| 4,730,953 | A | * | 3/1988 | Tarko | 405/45 |
| 4,745,716 | A | | 5/1988 | Kuypers | |
| 4,943,185 | A | * | 7/1990 | McGuckin et al. | 405/45 |
| 4,956,951 | A | * | 9/1990 | Kannakeril | 52/169.5 |
| 5,044,821 | A | | 9/1991 | Johnsen | |
| 5,051,044 | A | | 9/1991 | Allen | |
| 5,052,161 | A | * | 10/1991 | Whitacre | 52/389 |
| D329,297 | S | | 9/1992 | Smith | |
| 5,256,007 | A | * | 10/1993 | Allen | 405/258 |
| 5,303,669 | A | * | 4/1994 | Szekely | 116/205 |
| 5,399,406 | A | * | 3/1995 | Matsuo et al. | 428/57 |
| 5,460,867 | A | * | 10/1995 | Magnuson et al. | 428/178 |
| 5,489,462 | A | * | 2/1996 | Sieber | 428/174 |
| 5,619,832 | A | * | 4/1997 | Myrvold | 52/403.1 |
| 5,692,348 | A | * | 12/1997 | Ambrosino | 52/169.5 |
| 5,771,643 | A | | 6/1998 | Parker | |
| 5,775,039 | A | * | 7/1998 | McPherson | 52/169.5 |
| 6,241,421 | B1 | * | 6/2001 | Harvie et al. | 405/45 |

* cited by examiner

*Primary Examiner*—Carl D. Friedman
*Assistant Examiner*—Yvonne M. Horton
(74) *Attorney, Agent, or Firm*—Perman & Green, LLP

(57) ABSTRACT

A sub-floor, perimeter, L-shaped water drainage panel for new construction basements having walls and supporting footings for receiving and draining water running down the walls and/or water entering at the wall/footing interface. The plastic drainage panel is molded with a plurality of spaced frustroconical wells on vertical and horizontal sections thereof, to engage the wall and footing, and space the panels therefrom and to be filled with wet concrete composition, when the floor is poured, to support the wall and footing against the basement floor and prevent relative movement therebetween.

7 Claims, 3 Drawing Sheets

3
3
11
12
13
14
15
15a
16
17
18
18a
19
20
20a
21
22
23
24
24a
25
26

WALL AND SUB-FLOOR WATER DRAIN BARRIER PANEL FOR BASEMENT WATER-CONTROL SYSTEMS

BACKGROUND OF THE INVENTION

1. Field of the Invention

The present invention relates to improvements in wall and sub-floor water-control systems for receiving, channeling, collecting and expelling ground water from interior basement walls to beneath the floor of basements and over the footing or other subterranean rooms having walls, wall-supporting footings and a floor. The problems caused by the invasion of ground water into basements and other structures are numerous. Generally such water seeps into basements from the walls and perimeter of the floor at the floor-wall and wall-footing joints, and/or through floor cracks, due to external hydrostatic pressures of water in the ground.

2. Prior Art

Wall and sub-floor water drain conduit systems are known in the patent literature but most such systems present problems with respect to strength, clog-resistance, drainage capacity in both lateral and longitudinal directions over the footing, and other disadvantages which have prevented their use in commercial installations.

Reference is made to U.S. Pat. Nos. 4,245,443; 4,745,716; 5,051,044 and 5,771,643 as examples of proposed wall/footing water drain panels which are installed in position at the junction of the footing and the foundation wall prior to the pouring of the basement floor. Generally, these elongate panels are fabricated of relatively thin plastic which, depending upon design, can become crushed or distorted to some extent under the weight and pressure of the wet concrete composition poured thereagainst when the basement floor is formed, thereby narrowing or closing the water-escape channels between the panels and the wall and/or the surface of the footing. Also, in most such panels water is channeled in only one direction, down the wall and outwardly over the footing to the drain, while blocking the flow of water longitudinally along the surface of the footing. This presents problems when water escape is blocked or minimized in the lateral direction for any reason.

U.S. Pat. No. 4,745,716 discloses a nestable wall/footing water drain panel embodiment which provides substantial structural contact between the poured basement floor and both the foundation and the footing and which permits water escape in both the lateral and longitudinal directions through narrow conduits. The barrier panels of this patent are either cut or bent to form an upper wall diverter panel section and a lower footing diverter panel section in which the narrow water-escape conduits must be aligned and non-crimped. There is no planar or flat longitudinal conduit-free area to permit the panel to be bent or molded at an angle without interfering with drainage conduits nor is there any planar or linear longitudinal conduit-free area at the discharge edge of the lower panel section to prevent or block entry of the concrete floor composition into the narrow water-escape conduits.

Finally, reference is made of U.S. Pat. No. 5,044,821 which discloses a system for protecting exterior foundation walls from water from backfill, which comprises covering the walls with a water barrier film having projections for spacing the backfill from the surface of the wall. The thin barrier film is rollable, and has a bottom section which is provided with an embossed fold line or bending area to allow for transition between the vertical foundation wall and the horizontal exterior footing. The barrier film excludes water from penetration to the wall rather than admitting water and channeling it over the footing to a drain. Also, the barrier is not molded in L-shaped rigid configuration.

SUMMARY OF THE INVENTION

The present invention provides a nestable water-escape barrier panel which is molded in a 90° configuration, to conform to the angle between a foundation wall and its supporting footing, and which comprises a plurality of evenly-spaced frustroconical or tapered polygonal recessed well areas, such as pyramidal areas, which project from the outer surfaces of the barrier panel to provide a plurality of relatively small support areas with the wall and the footing, between which water is able to flow freely in all directions down the foundation wall and over the surface of the footing into a conventional footing drain or drain tile, or aggregate drain bed.

The tapered recessed well areas have larger openings at the inside surface of the barrier panel to receive the wet concrete composition and be filled thereby by displacing air as the basement floor is poured and flows over the wall footings and against the basement wall to a level below the top of the barrier panel. When the concrete floor cures, the concrete within the wells or recesses provides a plurality of evenly-spaced posts which engage the basement wall and the footing, against the thickness of the barrier panel, to provide high structural strength against any flattening or distortion of the barrier panel or movement of the basement wall, as may be caused by lateral soil pressures pushing the wall against the floor, or the weight of the floor against the footing.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
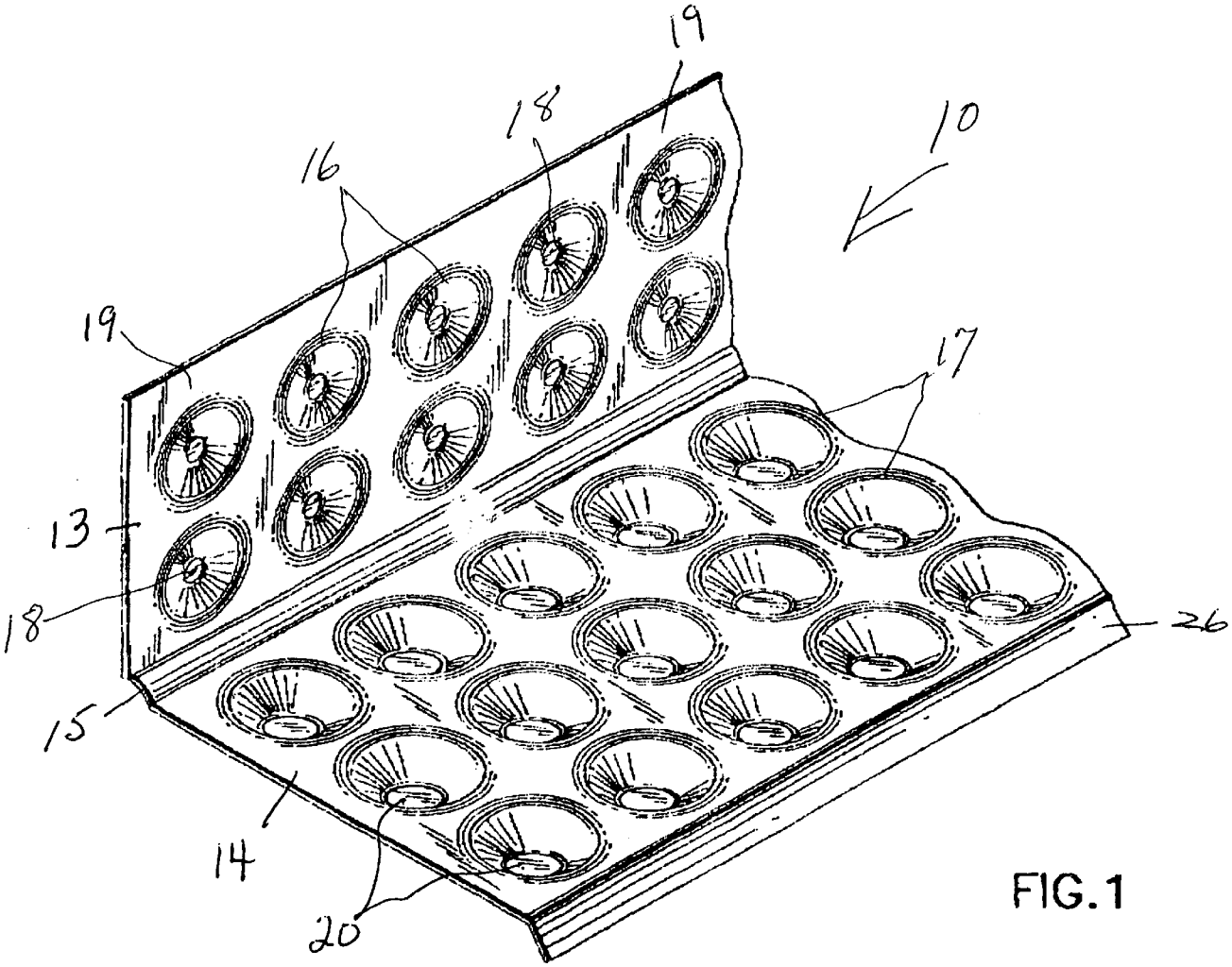
FIG. 1 is a perspective view of an elongate wall and sub-floor water drain barrier panel according to a preferred embodiment of the present invention.
Figure 2:
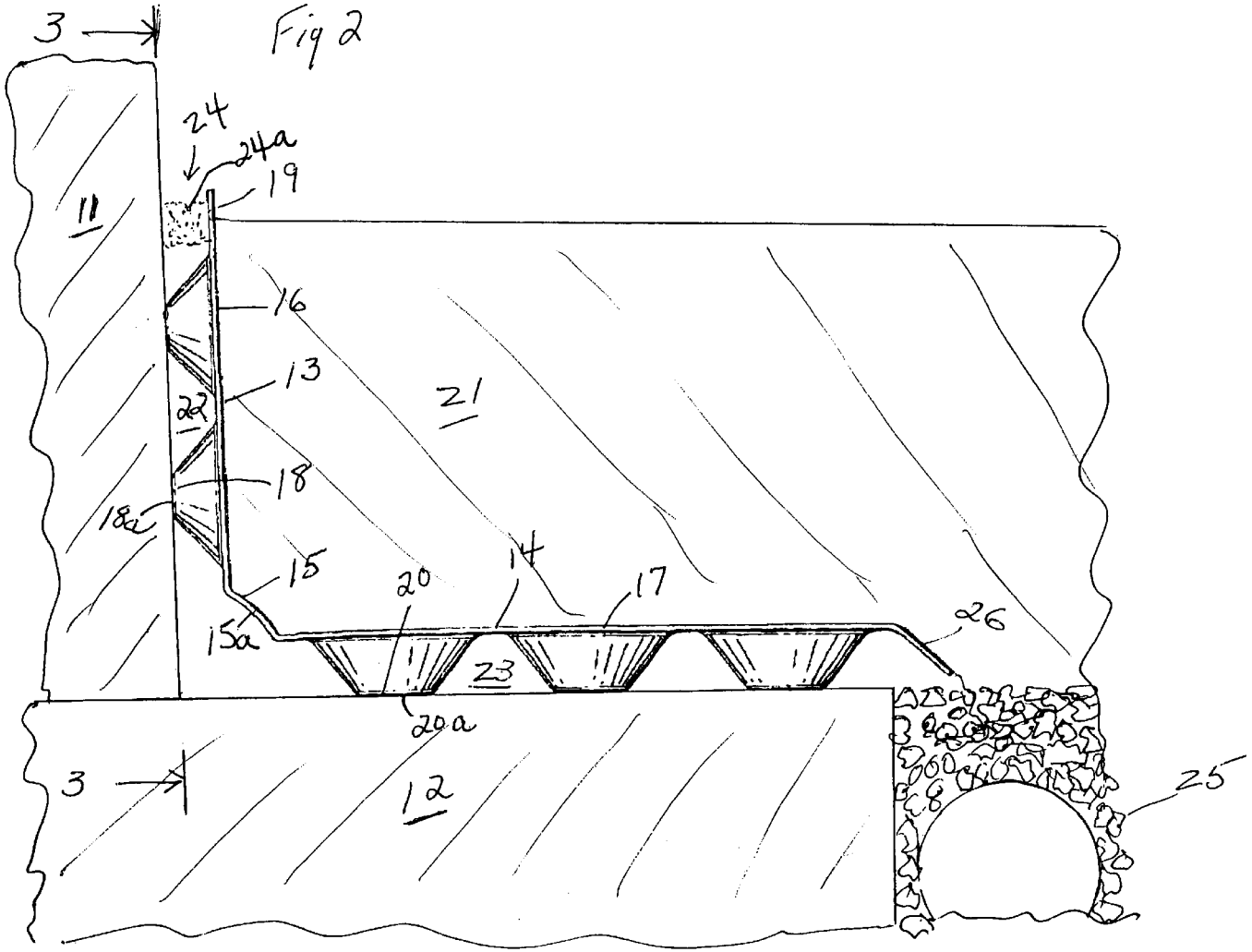
FIG. 2 is a side edge view of the panel of FIG. 1 positioned against a basement wall on the surface of a wall-supporting footing and covered by a poured and cured basement floor.

Referring to FIG. 1 of the drawings, the present wall and sub-floor water drain panel 10 is a strong, flexible, semi-rigid panel molded from a suitable plastic composition, such as a polystyrene, polyethylene, polyvinyl chloride, nylon or acrylonitrile-butadiene-styrene polymer (ABS), in an L-shaped or 90° angular fixed shape so as to conform to the angle formed between a basement wall 11 and its supporting concrete footing 12 as illustrated by FIG. 2. The panel 10 has an upper, vertical wall-engaging section 13 and a lower, horizontal footing-engaging section 14 separated by longitudinal flat transitioning area 15 which enables the panel to be molded in angular or L-shape without any interference with the molded frustroconical depressions or wells 16 or 17 on the panel sections 13 or 14. The vertical panel section 13 carries a plurality of uniformly-spaced, linearly-positioned wells 16 having walls which taper downwardly and inwardly to a seat or frustrum 18. Section 13 also is formed with an upper longitudinal marginal border 19.

The flat transitioning area 15 shown in the drawings is a preferred embodiment in that it provides a flat longitudinal surface 15*a* outwardly from the wall/floor interface, which increases the volume of the water flow area along the interface, makes room for any cement which might be exuded at the interface, thereby permitting the drain panel to seat against the wall and the floor, and imparts structural rigidity.

Figure 3:
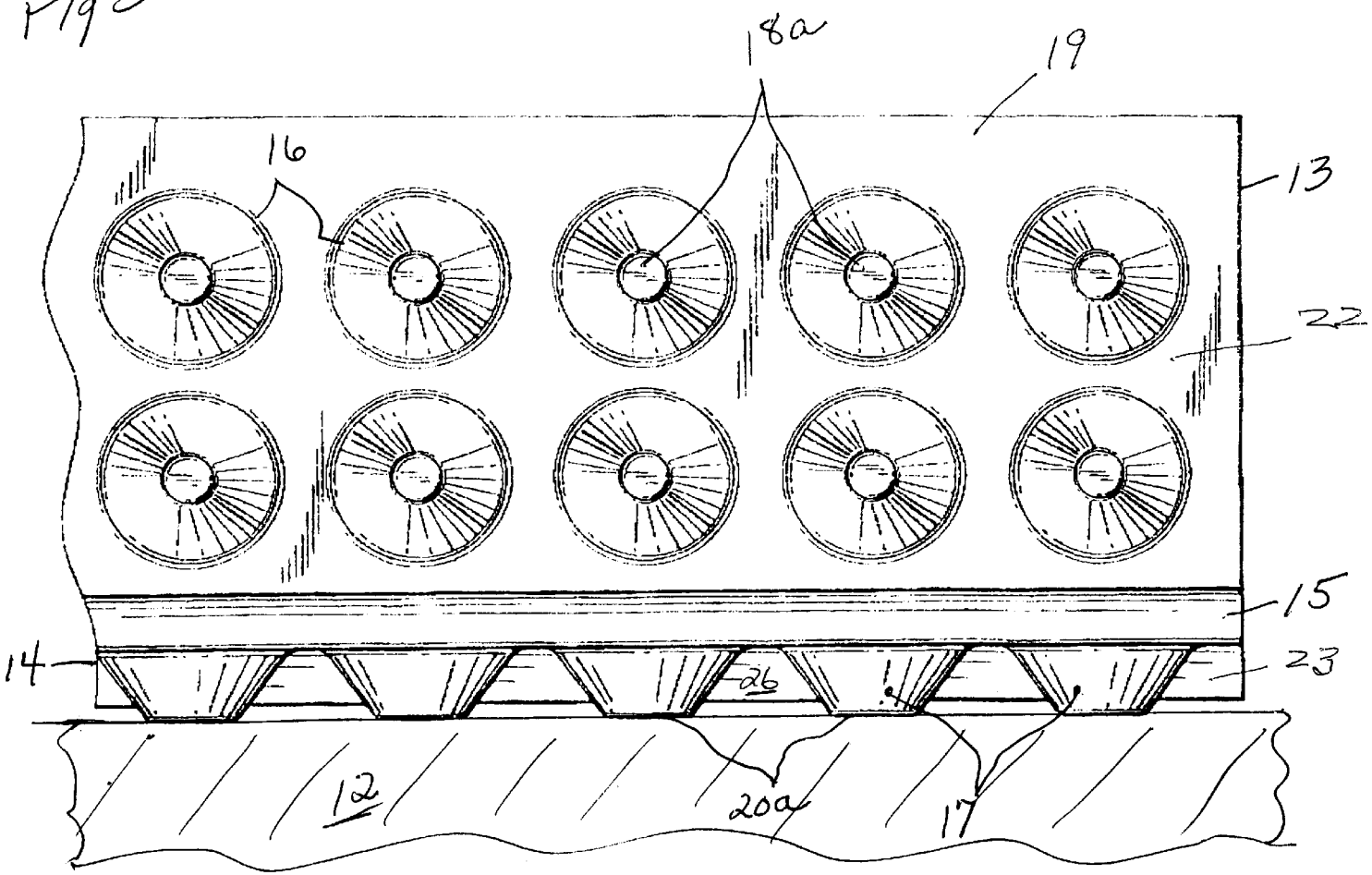
FIG. 3 is a wall view along the line 3—3 of FIG. 2 illustrating the spacing between and the relative sizes of the frustroconical projections on the upper wall-engaging vertical section and the lower, footing-engaging horizontal section of the panel.

The horizontal panel section 14 also carries a plurality of uniformly-spaced, linearly-arranged wells 17 having walls which taper downwardly and inwardly to a seat or frustrum 20. As illustrated by FIGS. 2 and 3, the wells 17 on panel section 14 are larger in diameter and are deeper than the wells 16 on panel section 13 but both have wide inlet ends to permit the wet concrete composition of the poured basement floor 21 to enter and fill the wells 16 and 17 down to their floor or frustrum 18 and 20 to support the panel 10 against the basement wall 11 and footing 12 and prevent collapse or narrowing of the water-flow space 22 between the panel section 13 and the surface of the wall 11, and the larger water flow space 23 between the panel section 14 and the upper surface of the footing 12. The marginal border 19 at the top of panel section 13 provides a barrier which prevents the wet concrete floor composition from flowing against the surface of the wall 11 and behind the panel section 13, and provides a uniformly-spaced continuous inlet 24 to permit water to flow down the surface of the wall 11, such as from cracks, down into the water-flow spaces 22 and 23.

The water-flow space 23 between the panel section 14 and the footing 12 is larger than space 22 because the greatest volume of incoming flood water generally enters between the base of the wall and the supporting surface of the footing or by gravity flow through hollow cement blocks, in the case of cement block walls. The water flows down in all directions through inlet 24 and spaces 22 and 23 and eventually flows over the edge of the footing 12 down into an aggregate drain tile 25 such as a porous drain pipe embedded in a gravel field. Also, the water flow space 23 is required to drain water which accumulates along the surface of the footing, from the wall/footing interface, and flows longitudinally along the length of the footing, as well as water which flows down the wall through water flow space 22.

Thus, the horizontal section 14 of the present drain panel 10 has an outer longitudinal marginal border 26 which extends beyond the edge of the footing 12 and preferably is tapered downwardly, as illustrated, to prevent the flow of the wet concrete floor composition under the panel section 14 and into the water-flow passage 22.

As can be seen from the present drawings, the outer surfaces 18*a* and 20*a* of the projections 16 and 17 provide a plurality of evenly-spaced small round contact areas with the wall 11 and footing 12, thereby minimizing any reduction in the area of the water-flow spaces 22 and 23 and permitting free water flow transversely and longitudinally behind and under the panel sections 13 and 14.

Most preferably the present semi-rigid water drain barrier panels 10 are molded of super high impact styrene polymer in a thickness of about 0.04" and then formed into the desired configuration. The spaced wells 16 molded down into the surface of the upper vertical panel section 13 have an entry diameter of about 1.38 inch, a depth to floor or seat 18 of about 0.38 inch, and a wall contact area 18*a* diameter of about 0.40 inch, providing a water flow passage 22 and inlet 24 about 0.38 inch wide between the panel section 13 and the surface of the wall 11. Panel section 13 has a height of about 4.25 inches above the surface of the footing 12, and the panel 10 preferably is formed in lengths of about six feet.

The preferred transition area is a chamfer or level area 15, as illustrated, since it imparts maximum rigidity to the panel 10 to retain its L-shape, and it also maximizes the water-flow space adjacent the interface of the wall 11 and the footing 12.

Alternatively the present panel sections 13 and 14 can be united by means of a living hinge or integral flexible hinge which allows the panel 10 to be opened into L-shape for installation.

The lower horizontal panel section 14 has a width of about 6 inches so that its outer marginal area 26 extends about an inch beyond the outer edge of the footing 12 to prevent the wet concrete composition from any back flow under the panel section 14 which would block the water flow from space 22 into the drain tile 25 conduit.

Panel section 14 also has formed therein a plurality of uniformly-spaced, linearly-arranged wells 17 molded down into the surface thereof but to a greater depth than wells 16 in section 14 to provide a larger water flow space 22 between the underside of panel section 14 and the surface of the footing 12. The frustroconical wells 17 have the same entrance diameter of about 1.38 inch as wells 16 but they taper at a larger angle than wells 16 and to a depth of about 0.5 inch down to floor or frustrum 20 to form footing contact areas 20*a* having a diameter of about 0.6 inch and a water flow space 22 height of about 0.5 inch between the underside of panel section 14 and the surface of the footing 12.

The design of the present drain panels 10 enables the wet, concrete floor composition to flow into the wide entrance areas of the tapered wells 16 and 17 to fill them and form uniformly spaced cured concrete posts or stand-offs which provide uniform structural strength between the basement floor 21 and the vertical basement wall 11 and the horizontal footing 12. More importantly, the plurality of uniformly spaced, small diameter contact areas 18*a* and 20*a* minimize the overall area of the drain panel 10 which contacts the wall 11 and footing 12 to less than 20%, preferably less than 10%, and maximize the area of the wall and footing which is free of contact and is open to the free flow of water in all directions. For example, the spaced contact areas 18*a* and 20*a* of the preferred barrier panel illustrated in the drawings cover only about 8% of the total surface of the wall 11 and the footing 12 beneath the panel sections 13 and 14 to provide a maximized water flow area of about 92%. The tapered shape of the wells 16 and 17 facilitate flow of the wet concrete composition to fill the wells and also minimizes the space within the water flow areas 22 and 23 which is displaced by the wells, to maximize the capacity of the water flow from areas 22 and 23.

Preferably, the present wells 16 and 17 are linearly arranged to enable the barrier panels to be nested and stacked, to minimize packaging and storage space, and to enable the panel lengths to be overlapped by one or more well lengths to conform to the overall length of the wall/footing area being covered, and to be overlapped to an angle of 90° in corner areas, if desired. Otherwise the plastic panels can be cut to desired lengths and angles, butted together, and caulked if desired.

Marginal border 19 of panel section 13 may be flat or planar, as illustrated, and left in place after the floor 21 is poured and cured, or may be cut along the floor line, after the floor is cured, in order to admit water from the floor into the inlet 24 which is level with the floor. Also, marginal border 19 may be tapered towards or against the wall 11 to close the inlet opening 24 while the floor 21 is being poured, to prevent entry of any wet concrete with the water flow space 22. Thereafter the border 19 can be cut along or above the floor line using a cutting blade tool.

Also, as shown in FIG. 2 of the drawings, the inlet 24 of the panel section 13 may be sealed along its entire length by means of a continuous water-permeable, air flow-preventing strip member 24*a* such as an open-cell foam of elastomeric material for purposes of blocking the escape of objectionable odors and dangerous gases, such as radon, from the ground into the basement rooms. The strip member 24*a* may be adhesively-bonded to the panel section 13 or to the wall 11 where shown in FIG. 2 or between the rows of projections 16 in space 22.

Finally, the present invention encompasses the use of drainage panels in which the vertical section 13 extends to any desired height above the floor and/or which is integrated or nested with full wall panels of similar dimpled plastic wall boards which enclose the entire basement wall periphery and provide an enclosed peripheral radon-trapping space 22 which can be vented to the atmosphere and vacated by means of a standpipe and fan. Adjacent panels can be nested and bonded together by means of sealing caulk and the upper ends of the dimpled panels can be sealed with caulk to enclose the overall air space 22 against the escape of radon or other gases and odors except through the provided venting means.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An elongate L-shaped semi-rigid molded plastic water-escape drainage panel designed for pre-construction installation on top of the wall-supporting footing along the wall/footing interface of a basement room prior to the pouring of a concrete basement floor, said panel having a vertical section having a planar inside wall surface containing a plurality of uniformly-spaced, inwardly-projecting well areas which receive concrete when the basement floor is poured thereagainst, to reinforce the drainage panel vertical section, each having a wall area which tapers inwardly from a relatively large opening at the inside surface of the panel section to a relatively small floor at the base of the well area, designed to supportingly engage the basement wall and provide an omnidirectional water flow space adjacent the basement wall, said panel also having a lower horizontal panel section having a planar upper surface wall containing a plurality of similar uniformly-spaced, downwardly-projecting well areas which receive concrete when the basement floor is poured thereover, to reinforce the drainage panel horizontal section, each having a wall area which tapers inwardly from a relatively large opening at the planar upper surface of the panel section and downwardly to a relatively small floor at the base of the well area, designed to supportingly engage the upper surface of the footing and provide an omnidirectional footing water flow space which communicates with the wall water flow space and extends beyond the edge of the footing to discharge the drain water into a drainage bed, the planar inside walls of said vertical panel section having a planar upper marginal area which is designed to extend up to or a small distance above the surface of the basement floor to prevent blockage of the wall water flow space and to admit water from the basement wall and/or from the surface of the basement floor, and the planar upper wall of the horizontal panel section having an outer marginal area which is designed to extend beyond the edge of the footing to prevent blockage of the footing water flow space with concrete composition when the basement floor is poured.

2. A drainage panel according to claim 1 which comprises a longitudinal transitional area, free of well areas, separating the vertical and horizontal sections and forming said L-shaped panel.

3. A drainage panel according to claim 1 in which said well areas are frustroconical in shape.

4. A drainage panel according to claim 1 in which said well areas are linearly-aligned in both the longitudinal and transverse directions.

5. A drainage panel according to claim 1 in which the well areas in the horizontal panel section are deeper than those in the vertical panel section to provide a larger water flow space adjacent the footing than adjacent the basement wall.

6. A drainage panel according to claim 1 in which the percentage of the total surface area of the wall and footing engaged by the outer surface of the drainage panel is less than about 20% of the total area of the wall and footing surface underlying said panel.

7. A drainage panel according to claim 6 in which said wall engagement percentage is less than about 10%.

* * * * *

UNITED STATES PATENT AND TRADEMARK OFFICE

CERTIFICATE OF CORRECTION

PATENT NO. : 6,672,016 B2
DATED : January 6, 2004
INVENTOR(S) : Janesky

It is certified that error appears in the above-identified patent and that said Letters Patent is hereby corrected as shown below:

Column 5,
Line 41, after "panel" insert -- installed --, delete "designed for pre-construction installation",
Lines 44 and 45, delete "prior to the pouring of" and insert -- and having --, after "floor" insert -- poured thereagainst --,
Line 46, after "inside" insert -- concrete floor-engaging --,
Line 47, delete "inwardly" and insert -- outwardly --,
Line 48, delete "receive" and insert -- are filled with --,
Line 50, after "section" insert -- against the basement wall", after "each" delete "having a", "wall" should read -- well --; after "area" delete "which tapers" and insert -- tapering --;

Column 6,
Line 1, after "the" insert -- planar --, after "inside" insert -- concrete floor engaging wall --;
Line 3, after "area," delete "designed to" after "supportingly" delete "enage" and insert -- engages --;
Line 4, delete "provide" and insert -- provides --;
Line 8, after "which" delete "receive" and insert -- are filled with --;
Line 11, after "planar" insert -- , concrete floor-engaging --;
Lines 13 and 14, delete "designed to" and insert -- which --; delete "engage" and insert -- engages --;
Line 15, delete "provide" and insert -- provides --;
Line 20, delete "designed to extend up to or" and insert -- extends --;
Line 23, delete "/or";
Line 25, delete "is designed to extend" and insert -- extends --.

Signed and Sealed this

Twelfth Day of October, 2004

JON W. DUDAS
*Director of the United States Patent and Trademark Office*